US005806038A

United States Patent [19]

Huang et al.

[11] Patent Number: 5,806,038

[45] Date of Patent: Sep. 8, 1998

[54] MBE SYNTHESIZER UTILIZING A NONLINEAR VOICING PROCESSOR FOR VERY LOW BIT RATE VOICE MESSAGING

[75] Inventors: Jian-Cheng Huang, Lake Worth; Floyd D. Simpson, Lantana; Xiaojun Li, Boynton Beach, all of Fla.

[73] Assignee: Motorola, Inc., Schaumburg, Ill.

[21] Appl. No.: 600,582

[22] Filed: Feb. 13, 1996

[51] Int. Cl.[6] ..... G10L 5/02; G10L 9/00

[52] U.S. Cl. ..... 704/268; 704/258

[58] Field of Search ..... 370/267; 395/2.1, 395/2.17, 2.67, 2.77; 704/201, 226, 258, 268

[56] References Cited

U.S. PATENT DOCUMENTS

| | | | |
|---|---|---|---|
| 4,885,790 | 12/1989 | McAulay et al. | 381/36 |
| 4,937,873 | 6/1990 | McAulay et al. | 179/528 |
| 5,081,681 | 1/1992 | Hardwick et al. | 381/51 |
| 5,195,166 | 3/1993 | Hardwick et al. | 395/2.09 |
| 5,216,747 | 6/1993 | Hardwick et al. | 395/2.17 |
| 5,226,108 | 7/1993 | Hardwick et al. | 395/2.09 |
| 5,317,567 | 5/1994 | Champion | 370/267 |
| 5,581,656 | 12/1996 | Hardwick et al. | 395/2.67 |
| 5,630,012 | 5/1997 | Nishiguchi et al. | 395/2.17 |

OTHER PUBLICATIONS

Pei–Xia et al, "Wavelet analysis based multiband excited vocoder," Proceedings TENCON '93, pp. 349–352 vol. 3, Oct. 1993.

Nishiguchi et al, "vector quantized MBE with simplified V/UV division at 3.0 kbps," ICASSP–93, pp. 151–154 vol. 2, Apr. 1993.

Torres–Guijarro et al, "improved analysis/synthesis methods for the multiband excitation coder," 7th Mediterranean electrotechnical conference, pp. 57–60 vol. 1, Apr. 1994.

*Primary Examiner*—Tariq R. Hafiz
*Attorney, Agent, or Firm*—Philip P. Macnak

[57] ABSTRACT

A MBE (Multi-Band Excitation) synthesizer (116) generates excitation components from information received by a receiver (2004). The information received includes spectral information representing a segment of speech. The MBE synthesizer (116) includes an excitation generator (2241) and a nonlinear voicing processor (2211). The excitation generator (2241) generates voiced excitation components and unvoiced excitation components. The nonlinear voicing processor (2211) is responsive to the spectral information and controls a selection of the excitation components from the voiced excitation components and the unvoiced excitation components.

12 Claims, 7 Drawing Sheets

108

116

MBE SYNTHESIZER UTILIZING A NONLINEAR VOICING PROCESSOR FOR VERY LOW BIT RATE VOICE MESSAGING

FIELD OF THE INVENTION

This invention relates generally to MBE synthesizers for use in communication receivers, and more specifically to an MBE synthesizer which utilizes very low bit rate data transmission rates in a compressed voice digital communication system to obtain high quality voice messages.

BACKGROUND OF THE INVENTION

Communications systems, such as paging systems, have had to in the past compromise the length of messages, number of users and convenience to the user in order to operate the systems profitably. The number of users and the length of the messages were limited to avoid over crowding of the channel and to avoid long transmission time delays. The user's convenience is directly affected by the channel capacity, the number of users on the channel, system features and type of messaging. In a paging system, tone only pagers that simply alerted the user to call a predetermined telephone number offered the highest channel capacity but were some what inconvenient to the users. Conventional analog voice pagers allowed the user to receive a more detailed message, but severally limited the number of users on a given channel. Analog voice pagers, being real time devices, also had the disadvantage of not providing the user with a way of storing and repeating the message received. The introduction of digital pagers with numeric and alphanumeric displays and memories overcame many of the problems associated with the older pagers. These digital pagers improved the message handling capacity of the paging channel, and provide the user with a way of storing messages for later review.

Although the digital pagers with numeric and alpha numeric displays offered many advantages, some user's still preferred pagers with voice announcements. In an attempt to provide this service over a limited capacity digital channel, various digital voice compression techniques and synthesis techniques have been tried, each with their own level of success and limitation. Voice compression methods, based on vocoder techniques, currently offer a highly promising technique for voice compression. Of the low data rate vocoders, the multi band excitation (MBE) vocoder is among the most natural sounding vocoder.

The vocoder analyzes short segments of speech, called speech frames, and characterizes the speech in terms of several parameters that are digitized and encoded for transmission. The speech characteristics that are typically analyzed include voicing characteristics, pitch, frame energy, and spectral characteristics. Vocoder synthesizers used these parameters to reconstruct the original speech by mimicking the human voice mechanism. Vocoder synthesizers modeled the human voice as an excitation source, controlled by the pitch and frame energy parameters followed by a spectrum shaping controlled by the spectral parameters.

The voicing characteristic describes the repetitiveness of the speech waveform. Speech consists of periods where the speech waveform has a repetitive nature and periods where no repetitive characteristics can be detected. The periods where the waveform has a periodic repetitive characteristic are said to be voiced. Periods where the waveform seems to have a totally random characteristic are said to be unvoiced. The voiced/unvoiced characteristics are used by the vocoder speech synthesizer to determine the type of excitation signal which will be used to reproduce that segment of speech.

Pitch defines the fundamental frequency of the repetitive portion of the voiced wave form. Pitch is typically defined in terms of a pitch period or the time period of the repetitive segments of the voiced portion of the speech wave forms. The speech waveform is a highly complex waveform and very rich in harmonics. The complexity of the speech waveform makes it very difficult to extract pitch information. Changes in pitch frequency must also be smoothly tracked for an MBE vocoder synthesizer to smoothly reconstruct the original speech. The human auditory process is very sensitive to changes in pitch and the perceived quality of the reconstructed speech is strongly effected by the accuracy of the pitch derived.

Frame energy is a measure of the normalized average RMS power of the speech frame. This parameter defines the loudness of the speech during the speech frame.

The spectral characteristics define the relative amplitude of the harmonics and the fundamental pitch frequency during the voiced portions of speech and the relative spectral shape of the noise-like unvoiced speech segments. The data transmitted defines the spectral characteristics of the reconstructed speech signal.

The human voice, during period that are classified as voiced, has portions of the spectrum that are unvoiced. MBE vocoders produce natural sounding voice because the excitation source, during a voiced period, is a mixture of voiced and unvoiced frequency bands. The speech spectrum is divided into a number of frequency bands and a determination is made for each band as to the voiced/unvoiced nature of each band. In conventional MBE vocoders, the band voiced/unvoiced information can be transmitted or can be determined by the synthesizer using tables associated with the spectral vectors. Transmission of the band voiced/unvoiced data also substantially increases the quantity of data that must be transmitted while the use of tables by the synthesizer occupies a substantial quantity of memory.

Accordingly, what is needed for optimal utilization of a channel in a communication system, such as a paging channel in a paging system or a data channel in a non-real time one way or two way data communications system, is an MBE synthesizer to accurately reproduce voice from compressed data, without the transmission of multi-band voicing information or the use of tables while maintaining acceptable speech quality.

SUMMARY OF THE INVENTION

Briefly, according to a first aspect of the invention, an MBE synthesizer generates excitation components from information received by a receiver. The information received includes indexes which designate predetermined line spectral frequencies which are stored within the receiver as spectral vectors representing the spectral content of a segment of speech. The MBE synthesizer includes an excitation generator and a nonlinear voicing processor. The excitation generator generates voiced excitation components and unvoiced excitation components. The nonlinear voicing processor comprises a matrix multiplier for calculating a product of a predetermined matrix and the spectral vectors which comprise predetermined line spectral frequencies, a voicing metric calculator which is coupled to the matrix multiplier for calculating from the product a plurality of band voicing metrics, and a threshold comparator for comparing the plurality of band voicing metrics with a predetermined threshold value to derive an output vector comprising a plurality of binary voicing metrics which control a selection of the excitation components for the number of bands within the segment of speech from the voiced excitation components and the unvoiced excitation components.

Briefly, according to a second aspect of the invention, an MBE synthesizer generates a segment of speech from compressed speech data which is received by a receiver which is coupled to the MBE synthesizer. The compressed speech data received includes one or more indexes. The MBE synthesizer includes an excitation generator, a memory, a harmonic amplitude estimator, a multi-band voicing controller and a multiplier. The excitation generator generates voiced excitation components and unvoiced excitation components. The memory stores a table of predetermined spectral vectors which are identified by indexes and which comprise predetermined line spectral frequencies. The harmonic amplitude estimator is responsive to one or more predetermined spectral vectors identified by the one or more indexes received, and generates harmonic amplitude control signals. The multi-band voicing controller includes a nonlinear voicing processor. The nonlinear voicing processor comprises a matrix multiplier for calculating a product of a predetermined matrix and the one or more predetermined spectral vectors which comprise predetermined line spectral frequencies, a voicing metric calculator which is coupled to the matrix multiplier which calculates from the product, band voicing metrics, and a threshold comparator for comparing the plurality of band voicing metrics with a predetermined threshold value, to derive an output vector comprising a plurality of binary voicing metrics which controls the selection of the excitation components for the number of bands within the segment of speech. The multiplier multiplies the harmonic amplitude control signals and the excitation components selected for generating spectral components representing the segment of speech.

DESCRIPTION OF A PREFERRED EMBODIMENT

Figure 1:
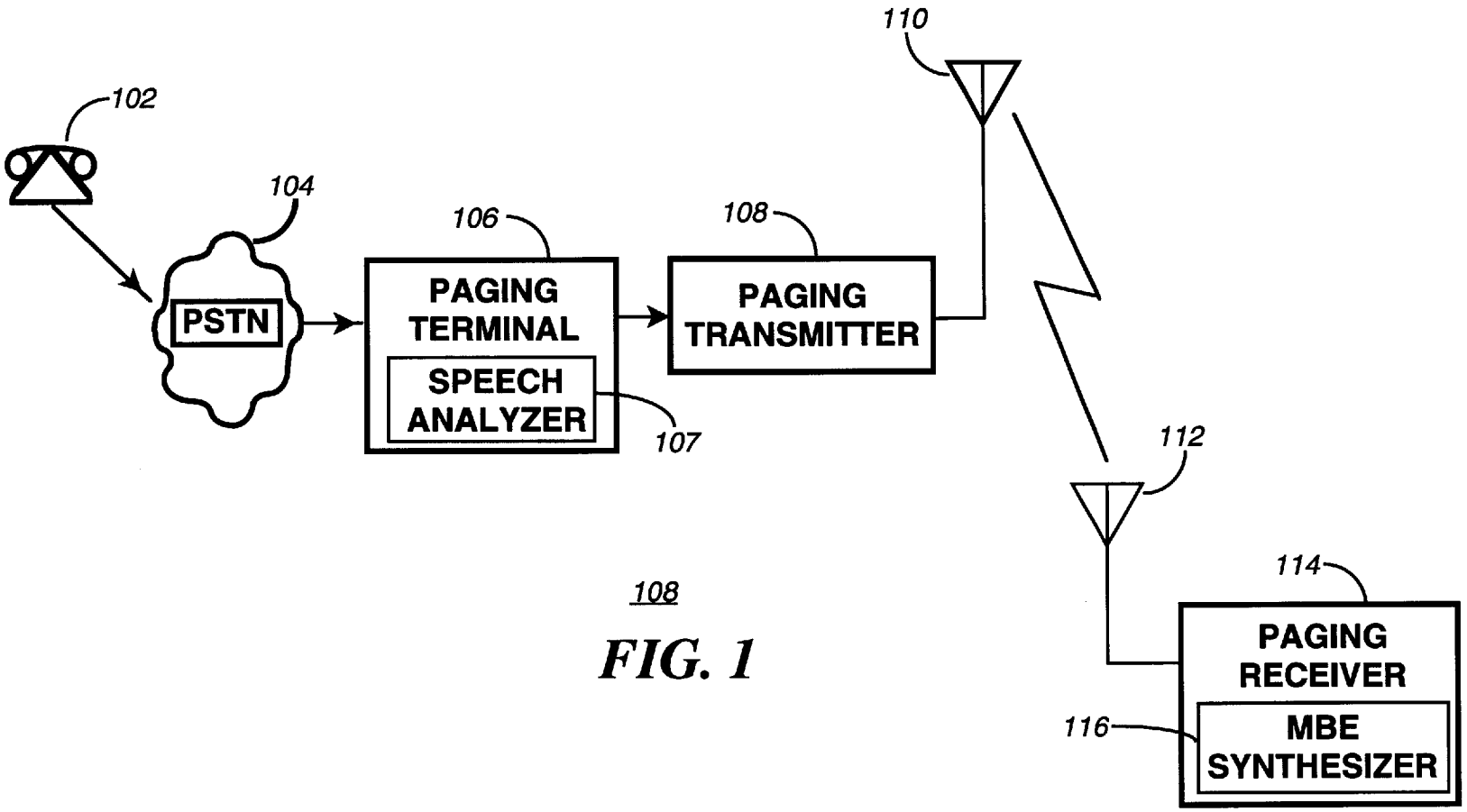
FIG. 1 is a block diagram of a very low bit rate voice messaging system using an improved MBE synthesizer in accordance with the present invention.

FIG. 1 is a block diagram of a very low bit rate voice messaging system, such as provided in a paging or data transmission system, which utilizes speech compression to provide a very low bit rate speech transmission using a Multi Band Excitation (MBE) synthesizer in accordance with the present invention. As will be described in detail below, a paging terminal 106 uses an unique speech analyzer 107 to generate excitation parameters and spectral parameters representing speech data, and the communication receiver, such as a paging receiver 114, uses an MBE synthesizer 116 to reproduce the original speech.

By way of example, a paging system will be utilized to describe the present invention, although it will be appreciated that any non-real time communication system will benefit from the present invention as well. A paging system is designed to provide service to a variety of users, each requiring different services. Some of the users may require numeric messaging services, other users alpha-numeric messaging services, and still other users may require voice messaging services. In a paging system, the caller originates a page by communicating with a paging terminal 106 via a telephone 102 through a public switched telephone network (PSTN) 104. The paging terminal 106 prompts the caller for the recipient's identification, and a message to be sent. Upon receiving the required information, the paging terminal 106 returns a prompt indicating that the message has been received by the paging terminal 106. The paging terminal 106 encodes the message and places the encoded message into a transmission queue. In the case of a voice message, the paging terminal 106 compresses and encodes the message using a speech analyzer 107. At an appropriate time, the message is transmitted using a transmitter 108 and transmitting antenna 110. It will be appreciated that a simulcast transmission system, utilizing a multiplicity of transmitters covering different geographic areas can be utilized as well.

The signal transmitted from the transmitting antenna 110 is intercepted by a receiving antenna 112 and processed by a receiver 114, shown in FIG. 1 as a paging receiver. Voice messages received are decoded and reconstructed using an MBE synthesizer 116. The person being paged is alerted and the message is displayed or annunciated depending on the type of messaging being received.

The digital voice encoding and decoding process used by the speech analyzer 107 and the MBE synthesizer 116, described herein, is readily adapted to the non-real time nature of paging and any non-real time communication system. These non-real time communication systems provide the time required to perform a highly computational compression process on the voice message. Delays of up to two minutes can be reasonably tolerated in paging systems, whereas delays of two seconds are unacceptable in real time communication systems. The asymmetric nature of the digital voice compression process described herein minimizes the processing required to be performed at the receiver 114, making the process ideal for paging applications and other similar non-real time voice communications. The highly computational portion of the digital voice compression process is performed in the fixed portion of the system, i.e. at the paging terminal 106. Such operation, together with the use of an MBE synthesizer 116 that operates almost entirely in the frequency domain, greatly reduces the computation required to be performed in the portable portion of the communication system.

The speech analyzer 107 analyzes the voice message and generates spectral parameters and excitation parameters. The spectral parameters are generated by first performing a fixed dimension LPC analysis. The LPC analysis generates ten spectral parameters. Two spectral code books are used to vector quantize the ten spectral parameters into two 11 bit indexes for transmission by the paging terminal 106. The speech analyzer 107 does not generate harmonic phase information as in prior art analyzers, but instead a unique frequency domain technique, described below, is used by the MBE synthesizer 116 to artificially regenerate phase information at the receiver 114. This unique technique eliminates the need to transmit additional data to convey the phase information.

The excitation parameters generated by the speech analyzer 107 to define a segment of speech preferably includes a seven bit pitch parameter, a six bit RMS parameter, and a one bit frame voiced/unvoiced parameter. Multi-band voicing information is not generated as in the prior art speech analyzers.

The pitch parameter defines the fundamental frequency of the repetitive portion of speech. Pitch is measured in vocoders as the period of the fundamental frequency.

The frame voiced/unvoiced parameter describes the repetitive nature of the speech. Segments of speech that have a highly repetitive waveform are described as voiced, whereas segments of speech that have a random waveform are described as being unvoiced. The frame voiced/unvoiced parameter generated by the speech analyzer 107 determines whether the MBE synthesizer 116 uses a periodic signal as an excitation source or a noise like signal source as an excitation source. Frames of speech that are classified as voiced often have spectral portions that are unvoiced. The MBE synthesizer 116 produces excellent quality speech by dividing the voice spectrum into a number of sub-bands and utilizing information describing the voiced/unvoiced nature of the speech signal in each sub-band. The sub-band voiced/unvoiced parameters, in conventional synthesizers, must be generated by the speech analyzer 107 and transmitted to the MBE synthesizer 116 or a set of tables that relate the sub-band voiced/unvoiced information and the spectral information must be stored in the receiver 114. In the present invention, the voicing information for each sub-band is generated by a unique nonlinear voicing processor which is part of the MBE synthesizer 116. The nonlinear voicing processor generates the sub-band voiced/unvoiced parameters by utilizing a correlation that exist between the sub-band voiced/unvoiced information and the spectral information. The operation of the nonlinear voicing processor is described below.

The RMS parameter is a measurement of the total energy of all the harmonics in a frame. The RMS parameter is generated by the speech analyzer 107 and is used by the MBE synthesizer 116 to establish the volume of the reproduced speech.

Figure 2:
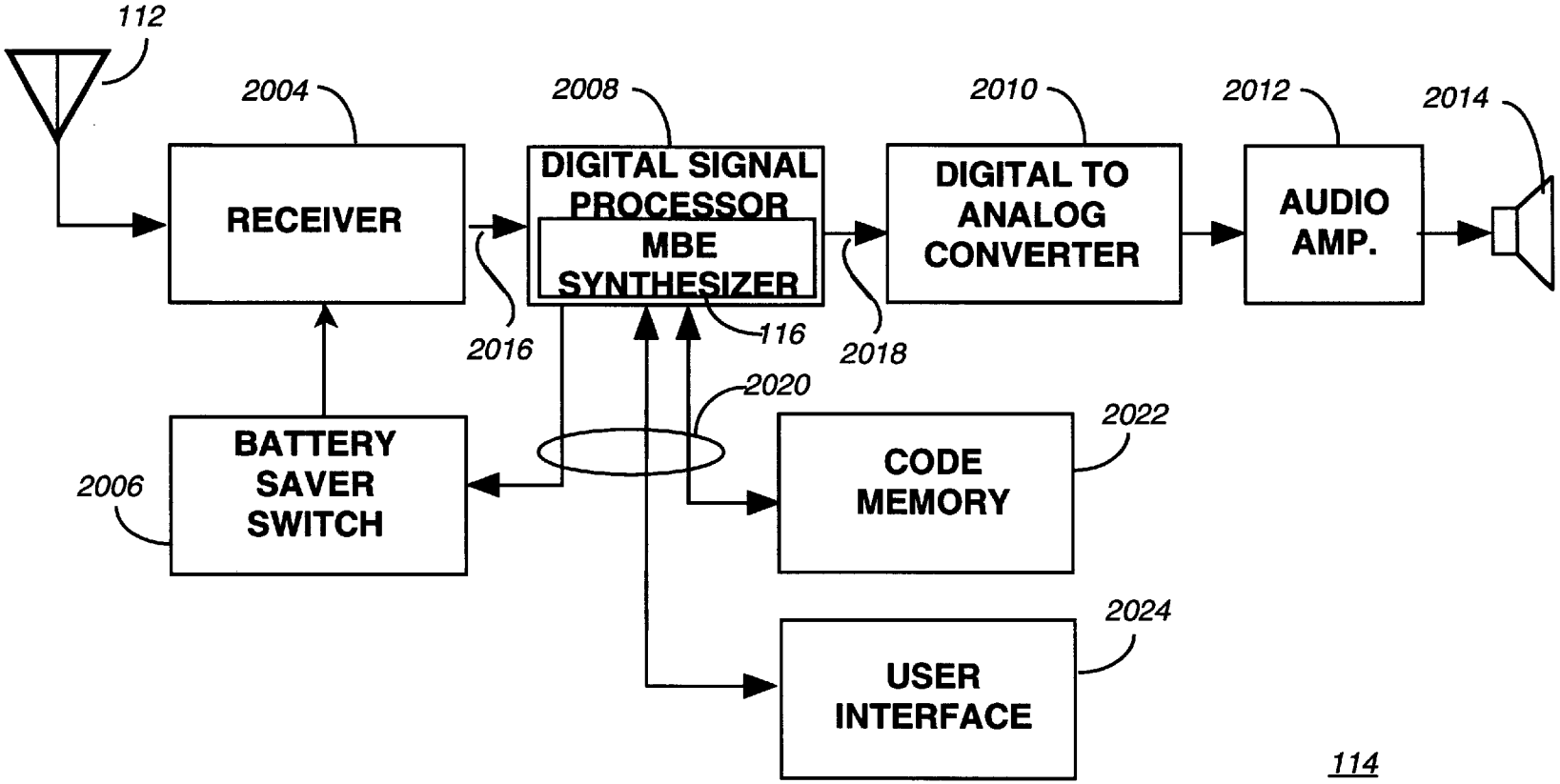
FIG. 2 is an electrical block diagram of the receiver shown in FIG. 1.

FIG. 2 is an electrical block diagram of the receiver 114 of FIG. 1, such as a paging receiver or data communication receiver. The signal transmitted from the transmitting antenna 110 is intercepted by the receiving antenna 112 which is coupled to a receiver 2004. The receiver 2004 processes the signal received by the receiving antenna 112 and produces a receiver output signal 2016 which is a replica of the encoded data transmitted. The encoded data is encoded in a predetermined signaling protocol. One such signaling protocol is the InFLEXion™ protocol, developed by Motorola Inc. of Schaumburg, Ill., although it will be appreciated that there are other suitable signaling protocols that can be utilized as well, for example, the Post Office Code Standards Advisory Group (POCSAG) code. A digital signal processor 2008 typically performs the function of a decoder, controller and MBE synthesizer 116 to process the receiver output signal 2016 and produce a decompressed digital speech data 2018 as will be described below. A digital to analog converter converts the decompressed digital speech data 2018 to an analog signal that is amplified by the audio amplifier 2012 and annunciated by a speaker 2014.

The digital signal processor 2008 also provides the basic control of the various functions of the receiver 114. The digital signal processor 2008 is coupled to a battery saver switch 2006, a code memory 2022 and a user interface 2024, via the control bus 2020. The code memory 2022 stores unique identification information or address information, necessary for the controller to implement the selective call feature. The user interface 2024 provides the user with an audio, visual or mechanical signal indicating the reception of a message and can also include a display and push buttons for the user to input commands to control the receiver. The battery saver switch 2006 provide a means of selectively disabling the supply of power to the receiver during a period when the system is communicating with other pagers or not transmitting, thereby reducing power consumption and extending battery life in a manner well known to one ordinarily skill in the art.

Figure 3:
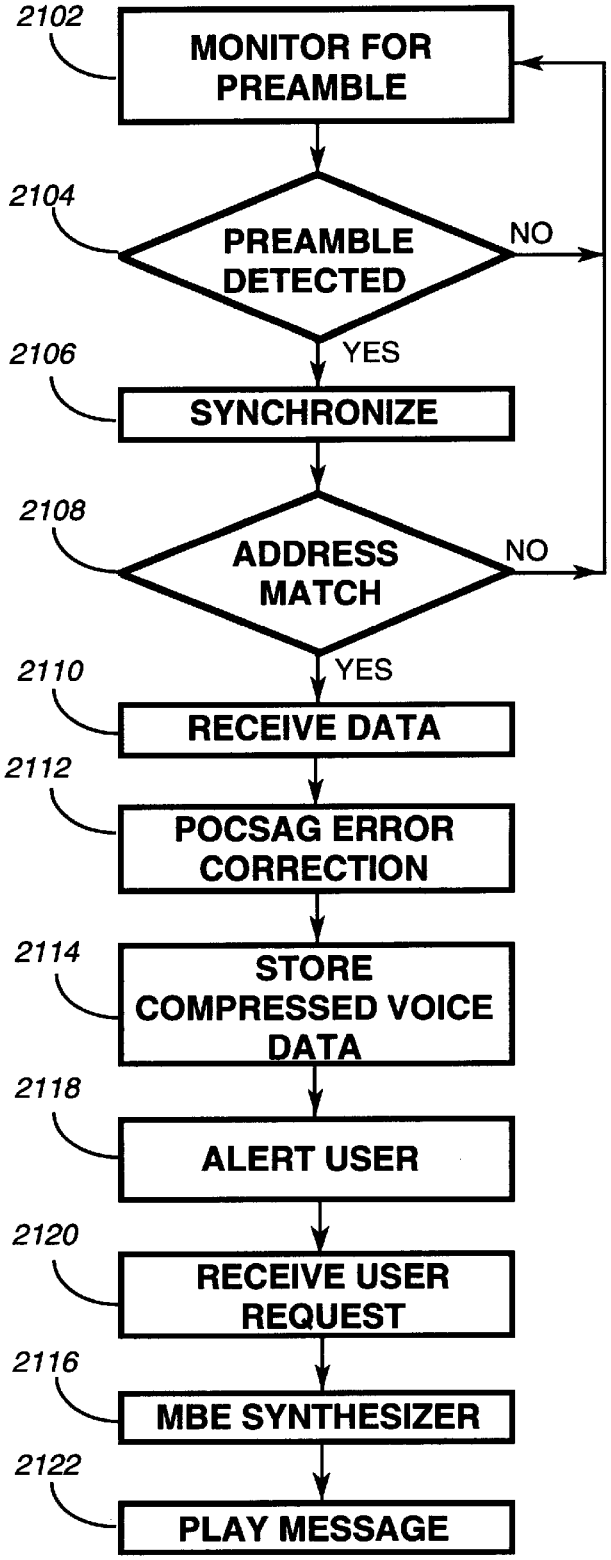
FIG. 3 is a flow chart which illustrates the operation of the receiver of FIG. 2.

FIG. 3 is a flow chart which illustrates the operation of the receiver 114 of FIG. 2. In step 2102, the digital signal processor 2008 sends a command to the battery saver switch 2006 to supply power to the receiver 2004. The digital signal processor 2008 monitors the receiver output signal 2016 for a bit pattern indicating that the paging terminal is transmitting a signal modulated with a preamble.

At step 2104, a decision is made as to the presence of the preamble. When no preamble is detected, then the digital signal processor 2008 sends a command to the battery saver switch 2006 to inhibit the supply of power to the receiver 2004 for a predetermined length of time. After the predetermined length of time, at step 2102, monitoring for preamble is again repeated as is well known in the art. In step 2104, when a preamble is detected, the digital signal processor 2008 will synchronize at step 2106 with the receiver output signal.

When synchronization is achieved, the digital signal processor 2008 may issue a command to the battery saver switch 2006 to disable the supply of power to the receiver 2004 until a frame assigned to the receiver 114 is expected. At the assigned frame, the digital signal processor 2008 sends a command to the battery saver switch 2006 to supply power to the receiver 2004. In step 2108, the digital signal processor 2008 monitors the receiver output signal 2016 for an address that matches the address assigned to the receiver 114. When no match is found the digital signal processor 2008 sends a command to the battery saver switch 2006 to inhibit the supply of power to the receiver until the next transmission of a synchronization code word or the next assigned frame, after which step 2102 is repeated. When an address match is found then in step 2108, power is maintained to the receiver 2004 and the data is received at step 2110.

In step 2112, error correction is performed on the data received in step 2110 to correct transmission errors that will affect the quality of the voice reproduced. The encoded frame provides nine parity bits which are used in the error correction process. Error correction techniques are well known to one of ordinary skill in the art. The corrected compressed voice data is stored in step 2114. Next in step 2118, the digital signal processor 2008 sends a command to the user interface 2024 to alert the user. Then in step 2120, the user enters a command to play out the message. The digital signal processor 2008 responds in step 2116 by processing the compressed stored voice data. The processing of digital voice data which includes de-quantizes and enhances the spectral information, combines the spectral information with excitation information, artificially generates phase information and synthesizes the voice data as will be described below.

In step 2122, the decompressed data is loaded into the digital to analog converter 2010. The digital to analog converter 2010 converts the digital speech data 2018 to an analog signal that is amplified by the audio amplifier 2012 and annunciated by speaker 2014.

Figure 4:
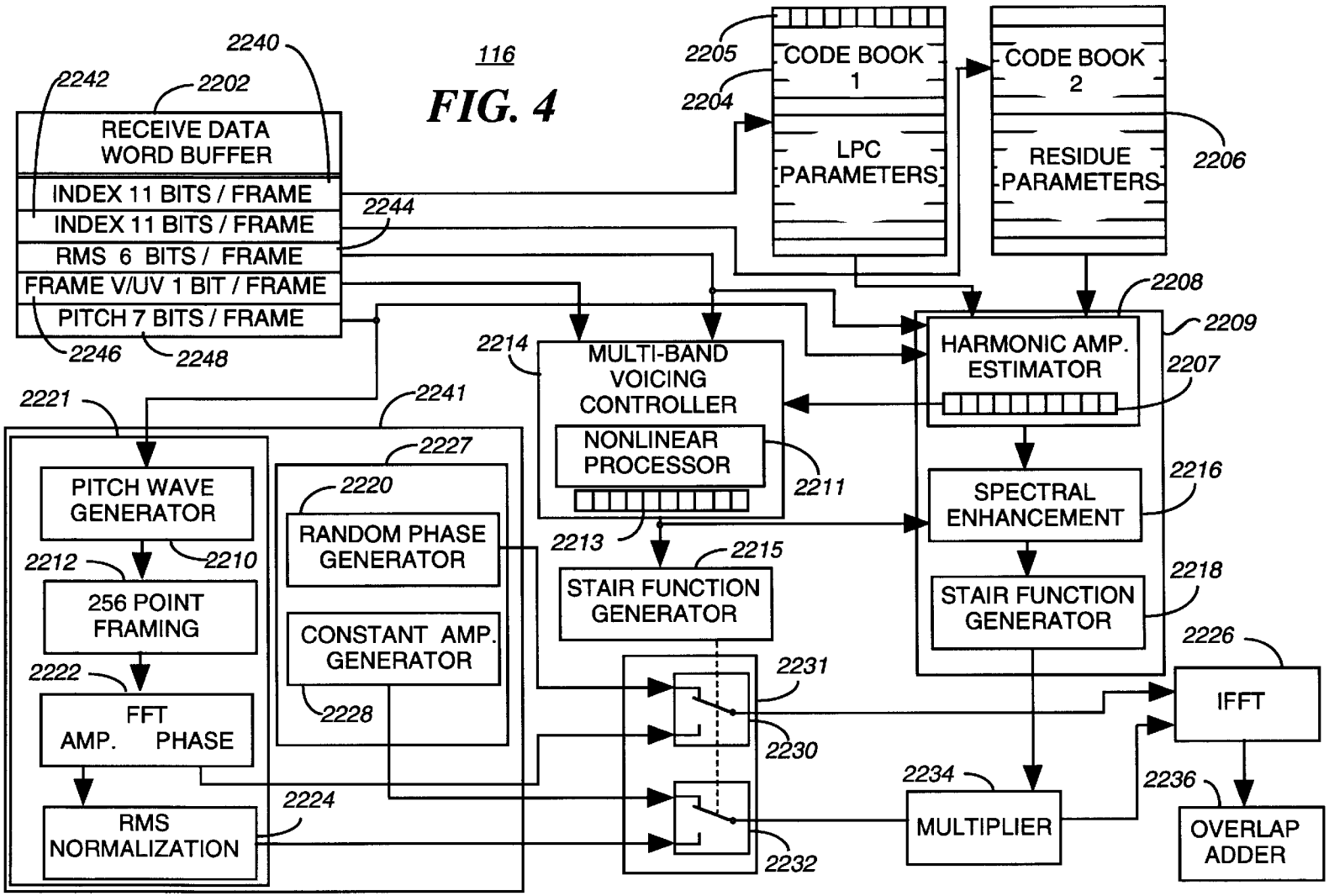
FIG. 4 is a block diagram showing the improved MBE synthesizer in accordance with the present invention.

FIG. 4 is a block diagram of the MBE synthesizer 116 shown in FIG. 2 and at step 2116 in FIG. 3. The MBE synthesizer 116 generates segments of speech from compressed speech data which are received by receiver 114 as preferably a thirty-six bit data word which is stored in an input buffer 2202. The input buffer 2202 preferably stores a minimum of two thirty-six bit data words representing at least two sequential segments of speech. The thirty-six bit data words stored in the input buffer 2202, and decoded in step 2114, comprise one or more indexes, a first eleven bit index 2240, a second eleven bit index 2242, a six bit RMS data 2244, a one bit of frame voicing data 2246 and seven bits of pitch data 2248. In the preferred embodiment of the present invention, the pitch signal has the range of 20 to 128. Also in the preferred embodiment of the present invention, a value of one is subtracted from the pitch data prior to transmission such that the pitch can be encoded using seven bits. A value of one is added back to the value of pitch stored in the input buffer 2202 at the receiver by the digital signal processor 2008 to correct for the value of one subtracted at the transmitter.

The first eleven bit index 2240 is coupled to a code book 2204 to provide a first index. The second eleven bit index 2242 is coupled to code book two 2206 to provide a second index. The code book 2204 stores a first table of predetermined spectral vectors 2205 and the code book two 2206 stores a second table of predetermined residue vectors. Each predetermined spectral vectors 2205 comprises a plurality of spectral parameters. Two LPC parameters, one from the code book 2204 indexed by the first eleven bit index 2240 and the second, a residue LPC parameters from code book two 2206 indexed by the second eleven bit index 2242, are coupled to a harmonic amplitude estimator 2208, a part of an improved harmonic amplitude estimator 2209. The six bit RMS data 2244 is also coupled to the harmonic amplitude estimator 2208. The improved harmonic amplitude estimator 2209 comprises the harmonic amplitude estimator 2208, a spectral enhancer 2216 and a stair function generator 2218.

The output of the harmonic amplitude estimator 2208 is coupled to a multi-band voicing controller 2214. The one bit of frame voicing data 2246 is also coupled to the multi-band voicing controller 2214. The output of the harmonic amplitude estimator 2208 is also coupled to the spectral enhancer 2216 which provides a spectral enhancement function. The output of the spectral enhancer 2216 is coupled to the stair function generator 2218 which in turn is coupled to a multiplier 2234.

An excitation generator 2241 generates transformed voiced excitation components and transformed unvoiced excitation components utilizing a transform function to be described below. The excitation generator 2241 comprises a voiced excitation generator 2221 and an unvoiced excitation generator 2227. The voiced excitation generator 2221 includes a pitch wave generator 2210, a 256 point framer 2212, a FFT transform generator 2222, and a RMS normalization 2224. The unvoiced excitation generator 2227 includes a random phase generator 2220, and a constant amplitude generator 2228. The seven bits of pitch data 2248 is coupled to the pitch wave generator 2210. The output of the pitch wave generator 2210 is coupled to the 256 point framer 2212 and the output of the 256 point framer 2212 is coupled to the FFT transform generator 2222. A phase output of the FFT transform generator 2222 is coupled to a spectral phase selector 2230. The output of the random phase generator 2220 is also coupled to the spectral phase selector 2230. An amplitude output of the FFT transform generator 2222 is coupled to the RMS normalization 2224 which is in turn coupled to a spectral amplitude selector 2232. The output of the constant amplitude generator 2228 is also coupled to the spectral amplitude selector 2232. The multi-band voicing controller 2214 is coupled to a stair function generator 2215 which in turn is coupled to and controls the spectral phase selector 2230 and the spectral amplitude selector 2232. The spectral phase selector 2230 and the spectral amplitude selector 2232 are also referred to herein as a selector 2231.

The output of the spectral phase selector 2230 is coupled to an IFFT inverse transform generator 2226. The output of the spectral amplitude selector 2232 is coupled to the multiplier 2234. The multiplier 2234 is also coupled to the harmonic amplitude estimator 2209 for generating spectral amplitude components which in turn are coupled to the IFFT inverse transform generator 2226. The output of the IFFT inverse transform generator 2226 is coupled to an overlap adder 2236 which produces digitized samples from which a replica of the original speech message can be reproduced.

The harmonic amplitude estimator 2208 receives a set of LPC parameters that reside in a predetermined spectral vector 2205 stored in a table of predetermined spectral vectors in code book 2204 which is indexed by the first eleven bit index 2240, a set of residue parameters that reside in a predetermined residue vector stored in a table of residue vectors in code book two 2206 which is indexed by the second eleven bit index 2242, and the seven bits of pitch data 2248 to generate a variable length harmonic amplitude function is described below. The table of predetermined spectral vectors 2205 stored in code book 2204 and the table of predetermined residue vectors stored in code book two 2206 are duplicates of the tables of predetermined spectral vectors, which comprise code books used by the paging terminal 106 during the speech compression process. The set of LPC parameters, indexed by the first eleven bit index 2240, are added to the set of residue parameters indexed by the second eleven bit index 2242, to produce a set of LPC parameters 2207 that are used to control the amplitude of the spectral component produced by the excitation generator 2241. Each LPC parameters of the set of LPC parameters 2207 is referred to as a line spectral frequency (LSF). The set of LPC parameters 2207 are also coupled to the multi-band voicing controller 2214 to derive a multi-band binary voicing vector, V 2213.

As described above, a set of two eleven bit code books is utilized, however it will be appreciated that any number of code books and code books of different sizes, for example ten bit code books or twelve bit code books, can be used as well. It will also be appreciated that a single code book having a larger number of predetermined spectral vectors and a single stage quantization process can also be used, or that a split vector quantizer which is well known to one or ordinary skill in the art can be used to code the spectral vectors as well. It will also be appreciated that two or more sets of code books representing different dialects or languages can also be provided.

The length of the variable length harmonic amplitude function is determined by the seven bits of pitch data 2248. The variable length function has one spectral gain parameter for each harmonic of the pitch signal. The generation of the pitch signal is described below. In the preferred embodiment of the present invention, the number of harmonics in the pitch signal is a function of the pitch and is calculated using the following formula.

$$N = (INT)\frac{.9375 * \text{Pitch}}{2}$$

Where;

INT is a function that returns a integer value and

N equals the number of harmonics.

The variable length harmonic amplitude function is multiplied by a value derived from the value of the six bit RMS code received as part of the thirty-six bit data word stored in the input buffer 2202. The RMS code sets the volume of the segment of speech being reproduced. The determination of the variable length harmonic amplitude function from the LPC parameters is made by the harmonic amplitude estimator 2208.

The parameters of the variable length harmonic amplitude function, generated by the harmonic amplitude estimator 2208, are analyzed and adjusted by a spectral enhancer 2216. The spectral enhancement function of the spectral enhancer 2216 compensates for the under estimation of the harmonic amplitude by harmonic amplitude estimator 2208 and for the spectral distortion generated by noise. The spectral enhancer 2216 generates an enhanced variable length harmonic amplitude function. It will be appreciated by one skilled in the art that the spectral information can also be pre-enhanced at the paging terminal 106 prior to transmission.

The stair function generator 2218 transforms the enhanced variable length harmonic amplitude function into a fixed length function of 128 points. The enhanced variable length harmonic amplitude function has one spectral gain parameter for each harmonic of the fundamental frequency of the pitch signal. The 128 points of the fixed length function are divided up into a number of bands, one band for each harmonic, with each band centered about each harmonic. The value of all the points of the function that fall into each band is set equal to the corresponding spectral gain parameter. The resulting spectral gain factor function has a stair step appearance.

The operation of the harmonic amplitude estimator 2209 is described in a related Patent Application, Attorney's Docket No. PT02124U, filed Jan. 26, 1996, by Huang, et al., entitled "Very Low Bit Rate Time Domain Speech Analyzer For Voice Messaging" which is assigned to the Assignee of the present invention.

Figure 5:
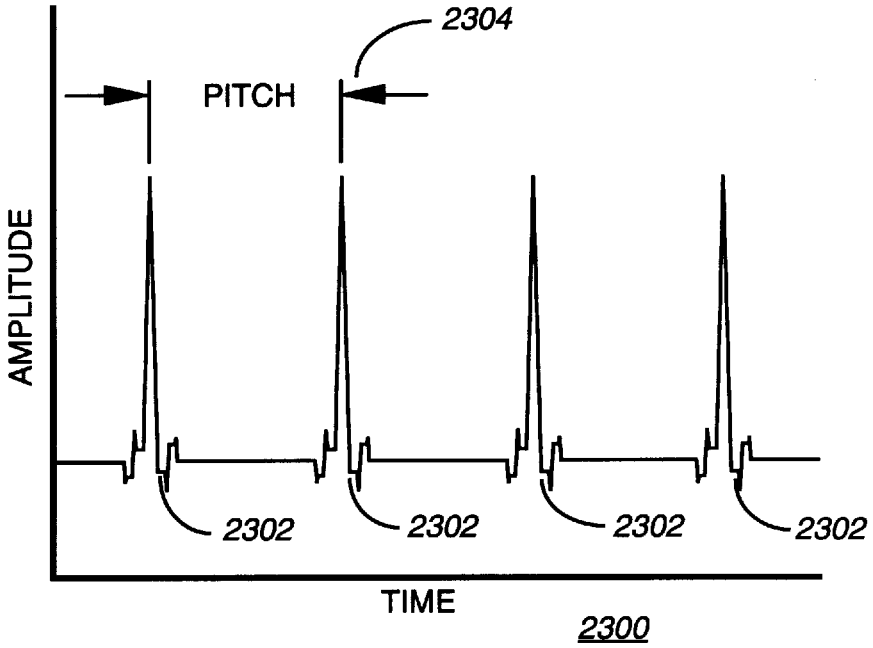
FIG. 5 shows the waveform of a typical pitch signal generated by the pitch generator shown in FIG. 4.

The pitch wave generator 2210 produces the basic synchronous pitch signal, responsive to the seven bits of pitch data 2248 that is received in the thirty-six bit data word and stored in a input buffer 2202. The synchronous pitch signal is used by the MBE synthesizer 116 to reproduce the original speech. The pitch is defined as the number of samples between the repetitive portions of the pitch signal. FIG. 5 shows, by way of example, the wave from of a typical pitch signal 2300. The waveform is a sequence of replicated, pre-defined pulses 2302 of a fixed duration with variable pitch distance 2304 between start of the pulses. The distance between the pre-defined pulses 2302 in the first half of the frame is continuously interpolated between the ending distance of the previous frame and the distance defined by the current seven bits of pitch data 2248 received. The distance in the last half of the frame is continuously interpolated between the distance defined by the current seven bits of pitch data 2248 received and the distance defined by the seven bits of pitch data 2248 received for the subsequent frame. Interpolation produces a pitch signal that smoothly follows the changes in the pitch data. In the preferred embodiment of the present invention, the pre-defined pulses 2302 are stored as a table of values in the MBE synthesizer 116.

Returning to FIG. 4, two hundred fifty six points of the pitch signal are framed by the 256 point framer 2212 to produce a windowed sequence of repetitive digitized pitch samples of a predetermined length. An FFT is performed on the 256 sample frame to produce a 128 point Fourier amplitude function containing discrete Fourier voiced amplitude components and a 128 point Fourier phase function containing discrete Fourier voiced phase components. Within the prior art, no phase information is transmitted in the present invention, and therefore the phase information must be regenerated by the FFT transform generator 2222, which calculates the FFT spectrum of the pitch signal 2300 which is used to derive phase information. This artificially generated phase information produces natural sounding speech without the burden of transmitting a large quantity of information which was necessary to convey the phase information, as in the prior art MBE synthesizers.

Each pre-defined pulses 2302, of FIG. 5 has a fixed duration and amplitude, resulting in a fixed amount of energy, and therefore the power of the pitch signal is a function of the number of pre-defined pulses 2302 in each frame. Frames having fewer pitch pulses have less power than frames having more pitch pulses. The RMS normalization 2224 normalizes the Fourier amplitude function to maintain the total energy at a predetermined energy level for pitch signals of all frames. The normalized Fourier amplitude function and Fourier phase function are used as an excitation source for the MBE synthesizer during voiced periods to reproduce the original speech.

During unvoiced periods, the constant amplitude generator 2228 produces discrete Fourier unvoiced amplitude components of a constant amplitude and the random phase generator 2220 produces discrete Fourier unvoiced phase components. The multi-band voicing controller 2214, described below provides signals to control the selection of the voiced and unvoiced excitation components.

Figure 6:
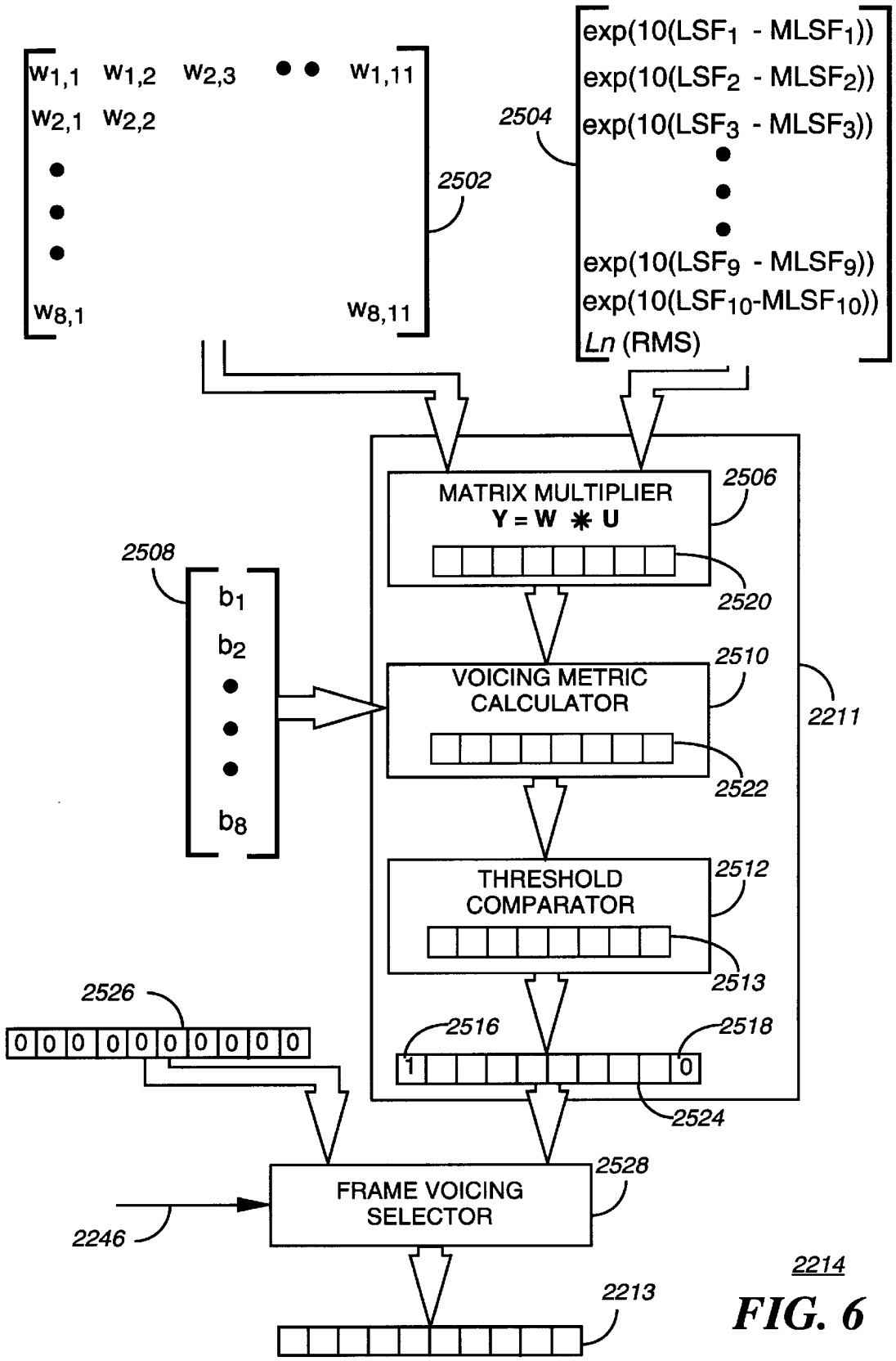
FIG. 6 is a diagram illustrating the operation of the nonlinear voicing processor used in the improved MBE synthesizer shown in FIG. 4.

FIG. 6 is diagram illustrating the operation of the multi-band voicing controller 2214 which includes the nonlinear voicing processor 2211. The multi-band voicing controller 2214 derives the parameters of a multi-band binary voicing vector, V 2213 from frame voicing information conveyed by the one bit of frame voicing data 2246, spectral information conveyed by the LPC parameters 2207 and frame power level conveyed by the six bit RMS data 2244. The output vector Q 2524 of the nonlinear voicing processor 2211 is coupled to the frame voicing selector 2528. Also coupled to the frame voicing selector 2528 is the unvoiced frame voicing parameters 2526 which are all set to zeros indicating, when selected, that all bands are to be unvoiced. The frame voicing selector 2528 selects the parameters of the multi-band binary voicing vector, V 2213 from the unvoiced frame voicing parameters 2526 when the one bit of frame voicing data 2246 has a value of zero and selects the parameters of the multi-band binary voicing vector, V 2213 from the output vector Q 2524 of the nonlinear voicing processor 2211 when the one bit of frame voicing data 2246 has a value of one.

The nonlinear voicing processor 2211 comprises a matrix multiplier 2506 coupled to a voicing metric calculator 2510 which is in turn coupled to a threshold comparator 2512 to generate the output vector Q 2524. The operation of the nonlinear voicing processor 2211 is primarily dependent on $LSF_1$ through $LSF_{10}$ for an input, however the addition of the natural log of the six bit RMS data 2244 to the input of the nonlinear voicing processor 2211 enhances the performance of the nonlinear voicing processor 2211. The input of the nonlinear voicing processor 2211 is arranged into a input vector U 2504. The input vector U 2504 includes input parameters $u_1$ through $u_{11}$. Input parameters $u_1$ through $u_{10}$ are derived from the set of LPC parameters 2207 comprising $LSF_1$ through $LSF_{10}$ using the following formula.

$$u_i = e^{(10 \cdot (LSF^i - MLSF^i))}$$

where $MLSF_i$ is the value of the mean value of $LSF_i$ derived from a very large number of samples of speech.

Input parameter $u_{11}$ is derived from the six bit RMS data 2244 using the following formula.

$$u_{11} = Ln(RMS)$$

The matrix multiplier 2506 multiplies a predetermined matrix W 2502 by the input vector U 2504 to produce an intermediate result coefficients $y_1$ through $y_8$ of intermediate result vector Y 2520. The predetermined matrix W 2502 comprises coefficients $w_{1,1}$ through $w_{8,11}$.

Matrix multiplication is a systematic procedure readily handled by a digital signal processor. The calculation of the first coefficient $y_1$ of the intermediate result vector Y 2520 involves calculating the summation of the following:

The product of the multiplication of the first coefficients of the first row of matrix W 2502, $w_{1,1}$ by the first coefficient of the first column $u_1$ of input vector U 2504, and the products of the multiplication's of the second through eleventh coefficients of the first row of matrix W 2502 by the second through seventh coefficients of the first column of input vector U 2504, respectively.

The calculations of the second through seventh coefficients, $y_2$ through $y_8$ are performed in a similar manner using the second through seventh rows of matrix W 2502, respectively and the first column of input vector U 2504.

The voicing metric calculator 2510 calculates a voicing metric vector M 2522 comprising voicing metrics $m_1$ through $m_8$ of from the intermediate result vector Y 2520. The voicing metrics $m_1$ through $m_8$ of the voicing metric vector M 2522 are parameters from which a band voicing determination can be made. The voicing metric calculator 2510 utilizes coefficients, $b_1$ through $b_8$ of a predetermined vector B 2508 and the following formula to calculate a voicing metric for the respective band.

$$m_i = \frac{1.0}{1.0 + e^{(-y_i - b_i)}}$$

The threshold comparator 2512 compares the voicing metrics of vector M with a predetermined threshold and stores a resulting binary voicing metric in the output vector Q 2524. Band one has such a high probability of being voiced, that in the preferred embodiment of the present invention, band one is assumed to be voiced, and the first binary voicing metric 2516 of output vector Q 2524 is preset to a value of one indicating the bands are voiced. Similarly band ten has a such a high probability of being unvoiced that it is assumed to be unvoiced and the tenth binary voicing metric 2518 of output vector Q 2524 is preset to a value of zero indicating the bands is unvoiced.

The result of the comparison of $m_i$ with the corresponding predetermined voicing threshold of the array of predetermined voicing thresholds 2513 determines the binary voicing metrics in the output vector Q 2524 for bands two through nine. Parameter $m_1$ is used to determine the binary voicing metric of band two, $m_2$ band three and so forth. When the parameter, $m_i$, is greater then the corresponding predetermined voicing threshold of the array of predetermined voicing thresholds 2513, then the band i+1 is determined to be voiced and a value of one is stored in the corresponding location of the output vector Q 2524. When the parameter, $m_i$, is not greater than the corresponding predetermined voicing threshold, then the band i+1 is determined to be unvoiced and a value of zero indicated the band is unvoiced is stored in the corresponding location of the output vector Q 2524. Preferably each band will have a individually determined predetermined voicing threshold. The value of the predetermined voicing thresholds of the array of predetermined voicing thresholds 2513 are determined through a training process described below.

The predetermined matrix W 2502, the predetermined vector B 2508 and the array of predetermined voicing thresholds 2513 are determined using an interactive training procedure. Interactive training procedures use a collection of training vectors and the corresponding band voicing decision derived from a very large number of segments of speech. Each training vector is composed of the LSFs and natural logs of the frame RMS value for each frame of speech. The parameters of the matrix W 2502, vector B 2508 and the array of predetermined voicing thresholds 2513 are the result of minimizing the mean-square error between the correct value of the voicing vector and the value produced by the training set. There are interactive procedures used in the field of pattern classification for optimization of the predetermined matrix W 2502, the predetermined vector B 2508, and the array of predetermined voicing thresholds 2513 that are well known to one ordinarily skilled in the art.

The digital signal processor 2008 in the receiver 114 typically performs the operations of the matrix multiplier 2506, the voicing metric calculator 2510, and the threshold comparator 2512. The spectral information, in the example described above, is conveyed in the form of LPC parameters 2207, however it will be appreciated that other methods of conveying spectral information will work as well, for example, FFT coefficients and log area ratio (LAR) coefficients.

Returning to FIG. 4, the multi-band binary voicing vector, V 2213 is coupled to the spectral phase selector 2230 and the spectral amplitude selector 2232 via the stair function generator 2215. The stair function generator 2215 transforms the multi-band binary voicing vector, V 2213 into a binary function of 128 points. The 128 points of the function are divided up into ten bands, one band for each of the band binary voicing parameter in the multi-band binary voicing vector, V 2213. The value of all the points of the fixed length function that fall into each band is set equal to the corresponding band binary voicing parameter.

When a parameter of the multi-band binary voicing vector, V 2213 is set to a value of 1, indicating a voiced band, the spectral phase selector 2230 selects phase excitation components from the FFT transform generator 2222 and the spectral amplitude selector 2232 selects amplitude excitation components from the FFT transform generator 2222 for that band. When a parameter of the multi-band binary voicing vector, V 2213 is set to a value of 0 indicating a unvoiced band, the spectral phase selector 2230 selects the phase excitation components from the random phase generator 2220 and the spectral amplitude selector 2232 selects amplitude excitation components from the constant amplitude generator 2228 for that band.

The FFT amplitude function from the spectral amplitude selector 2232 is coupled to the multiplier 2234. The multiplier 2234 multiplies the Fourier amplitude function from the spectral amplitude selector 2232 by harmonic amplitude control signals defined in the spectral gain factor function generated by the stair function generator 2218 to produce a Fourier function containing the spectral amplitude information.

The phase information from the spectral phase selector 2230 and the Fourier function from the multiplier 2234 are coupled to the IFFT inverse transform generator 2226. The IFFT inverse transform generator 2226 performs a Inverse Fourier Transform (IFFT) to produce a time domain function. The time domain function is overlapped by the past and future frame in the overlap adder 2236 to generate a pulse amplitude coded representation of the original speech. The sampled speech segments are extended such that all segments overlap the previous and future segments by fifty percent. An overlap adder function 2236 tends to smooth the transition between speech segments. The operation of the overlap adder function 2236 is well known to one of ordinary skill in the art.

Figure 7:
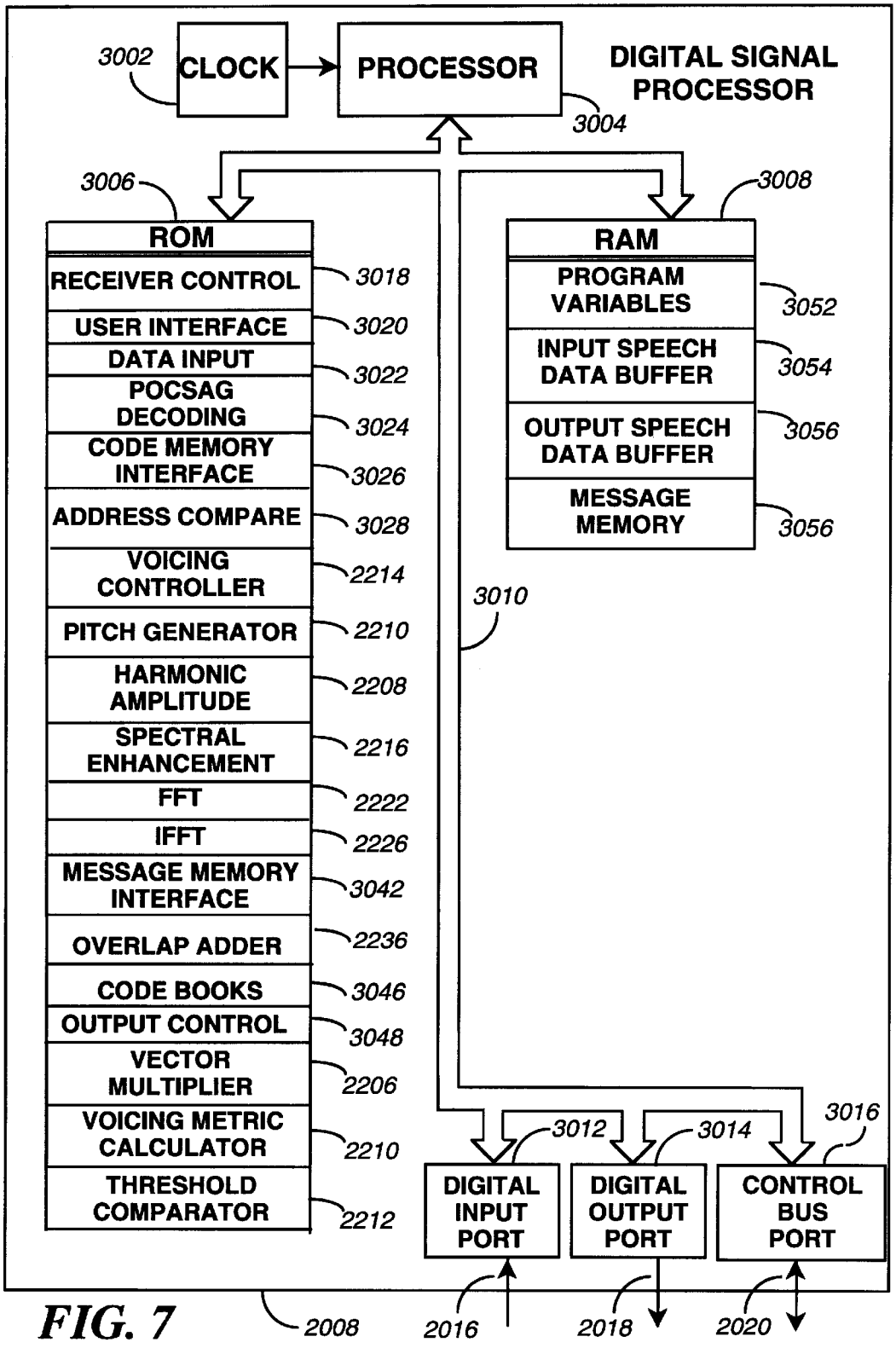
FIG. 7 is an electrical block diagram of a digital signal processor used in the receiver 114 of FIG. 2.

FIG. 7 shows an electrical block diagram of the digital signal processor 2008 used in the receiver 114 shown in FIG. 2. The processor 3004, is one of several standard commercially available digital signal processor ICs specifically designed to perform the computations associated with digital signal processing. Digital signal processor ICs are available from several different manufactures. One such processor is the DSP56100 manufactured by Motorola Inc. of Schaumburg, Ill. The processor 3004 is coupled to a read only memory (ROM) 3006, a RAM 3008, a digital input port 3012, a digital output port 3014, and a control bus port 3016, via the processor address and data bus 3010. The ROM 3006 stores the instructions used by the processor 3004 to perform the signal processing function required to decompress the message and to interface with the control bus port 3016. The ROM 3006 also contains the instructions to perform the functions associated with compressed voice messaging. The RAM 3008 provides temporary storage of program variables 3052, an input speech data buffer 3054, a output data speech buffer 3056 and a message memory 3058. The message memory 3058 provides a place to store messages for future review, or to allow the user to repeat the message. It will be appreciated that the RAM 3008 can be composed of more than one type of RAM, for example, dynamic RAM for short term storage of program variables 3052 and static RAM for long term storage of messages. The digital input port 3012 provides the interface between the processor 3004 and the receiver 2004 under control of the data input function. The digital output port 3014 provides the interface between the processor 3004 and the digital to analog converter 2010 under control of the output control function. The control bus port 3016 provides an interface between the processor 3004 and the control bus 2020. A clock 3002 generates a timing signal for the processor 3004.

The ROM 3006 stores by way of example the following: a receiver control function routine 3018, a user interface function routine 3020, a data input function routine 3022, a POCSAG decoding function routine 3024, a code memory interface function routine 3026, an address compare function routine 3028, a processing routine for the multi-band voicing controller 2214, a processing routine for the pitch wave generator 2210, a processing routine for the harmonic amplitude estimator 2208, a processing routine for the spectral enhancer 2216, a processing routine for the FFT transform generator 2222, a processing routine for the IFFT inverse transform generator 2226, a message memory interface function routine 3042, a processing routine for the overlap adder 2236, an output control function routine 3048, a processing routine for a matrix multiplier 2506, a processing routine for a voicing metric calculator 2510, a processing routine for a threshold comparator 2512 and one or more code books 3046 comprising one or more tables of predetermined spectral vectors 2205 identified by indexes, as described above.

In summary, a MBE synthesizer is described herein that accurately reproduce voice from compressed data, without the transmission of multi-band voicing information or the use of voicing tables in the receiver while maintaining good speech quality. The generation of multi-band voicing information using the multi-band voicing controller described above reduces the size of the ROM required in the receiver, an important consideration when designing portable equipment and reduces the quantity of data that must be transmitted, another important consideration when designing a communication system that has maximum capacity.

As hitherto stated, a very low bit rate voice messaging system in accordance with the present invention digitally encodes the voice messages in such a way that the resulting data is very highly compressed and can easily be mixed with the normal data sent over a paging channel. The operation of the MBE synthesizer in accordance with the present invention provides an apparatus and method for providing multi-band voicing information which is not provided in the transmission of the encoded speech. While specific embodiments of this invention have been shown and described, it can be appreciated that further modification and improvement will occur to those skilled in the art.

We claim:

1. A MBE (Multi-Band Excitation) synthesizer for generating excitation components from information received by a receiver, the information received including indexes which designate predetermined line spectral frequencies which are stored within the receiver as spectral vectors representing a segment of speech, said MBE synthesizer comprising:

an excitation generator for generating voiced excitation components and unvoiced excitation components; and a nonlinear voicing processor, comprising a matrix multiplier for calculating a product of a predetermined matrix and the spectral vectors comprising predetermined line spectral frequencies, a voicing metric calculator, coupled to the matrix multiplier, for calculating from the product a plurality of band voicing metrics, and a threshold comparator for comparing the plurality of band voicing metrics with a predetermined threshold value, to derive an output vector comprising a plurality of binary voicing metrics for controlling a selection of the excitation components for the number of bands within the segment of speech from the voiced excitation components and the unvoiced excitation components for the segment of speech.

2. The MBE synthesizer according to claim 1, wherein one or more of the plurality of binary voicing metrics are preset.

3. The MBE synthesizer according to claim 1, wherein the excitation components which are voiced comprise discrete Fourier voiced amplitude components and discrete Fourier voiced phase components, and wherein the excitation components which are unvoiced comprise discrete Fourier unvoiced amplitude components and discrete Fourier unvoiced phase components.

4. The MBE synthesizer according to claim 1, wherein the MBE synthesizer further comprises a frame voicing selector for controlling a selection of the plurality of binary voicing metrics.

5. The MBE synthesizer according to claim 4, wherein the information received further includes frame voicing data identifying that a segment of speech is unvoiced, and wherein the frame voicing selector is responsive to the frame voicing data for controlling the selection of unvoiced excitation components during the segment of speech.

6. An MBE (Multi-Band Excitation) synthesizer for generating a segment of speech from compressed speech data which is received by a receiver coupled thereto, the compressed speech data which is received includes one or more indexes, the MBE synthesizer comprising:

an excitation generator for generating excitation components including voiced excitation components and unvoiced excitation components;

a memory for storing a table of predetermined spectral vectors which are identified by indexes and which comprise predetermined line spectral frequencies;

a harmonic amplitude estimator, responsive to one or more predetermined spectral vectors identified by indexes corresponding to the one or more indexes received, and for generating therefrom harmonic amplitude control signals;

a multi-band voicing controller comprising a nonlinear voicing processor comprising a matrix multiplier for calculating a product of a predetermined matrix and the one or more predetermined spectral vectors comprising predetermined line spectral frequencies, a voicing metric calculator, coupled to the matrix multiplier, for calculating from the product a plurality of band voicing metrics, and a threshold comparator for comparing the plurality of band voicing metrics with a predetermined threshold value, to derive an output vector comprising a plurality of binary voicing metrics for controlling a selection of the excitation components for the number of bands within the segment of speech from the voiced excitation components and the unvoiced excitation components for the segment of speech; and a multiplier, for multiplying the harmonic amplitude control signals and the excitation components selected, for generating spectral components representing the segment of speech.

7. The MBE synthesizer according to claim 6, further comprising an input buffer, coupled to the receiver, for storing the compressed speech data including the one or more indexes received.

8. The MBE synthesizer according to claim 6, wherein one or more of the plurality of binary voicing metrics are preset.

9. The MBE synthesizer according to claim 6, wherein the MBE synthesizer further comprises a frame voicing selector for controlling a selection of the plurality of binary voicing metrics.

10. The MBE synthesizer according to claim 9, wherein the compressed speech data further includes frame voicing data identifying that a segment of speech is unvoiced, and wherein the frame voicing selector is responsive to the frame voicing data for controlling the selection of unvoiced excitation components during the segment of speech.

11. The MBE synthesizer according to claim 6, wherein the excitation components which are voiced comprise discrete Fourier voiced amplitude components and discrete Fourier voiced phase components, and wherein the excitation components which are unvoiced comprise discrete Fourier unvoiced amplitude components and discrete Fourier unvoiced phase components.

12. The MBE synthesizer according to claim 11 wherein said multi-band voicing controller controls a selection of phase excitation components from the discrete Fourier voiced phase components and from the discrete Fourier unvoiced phase components, the phase excitation components selected representing spectral phase components, and further controls a selection of amplitude excitation components from the discrete Fourier voiced amplitude components and from the discrete Fourier unvoiced amplitude components, and wherein the MBE synthesizer further comprises a multiplier, for multiplying the harmonic amplitude control signals and the amplitude excitation components selected, for generating spectral amplitude components, and wherein said MBE synthesizer further comprises an inverse transform generator for transforming the spectral phase components and the spectral amplitude components into digitized samples representing the segment of speech.

* * * * *